United States Patent [19]

Gilbert

[11] 4,267,959

[45] May 19, 1981

[54] HINGED PAPERBOARD CONTAINER

[75] Inventor: Earl F. Gilbert, Farmington Hills, Mich.

[73] Assignee: Westvaco Corporation, New York, N.Y.

[21] Appl. No.: 87,013

[22] Filed: Oct. 22, 1979

[51] Int. Cl.[3] ..... B65D 5/46; B65D 25/22; B65D 5/22

[52] U.S. Cl. ..... 229/52 B; 229/33; 229/34 R

[58] Field of Search ..... 229/33, 34, 36, 52 B, 229/52 R

[56] References Cited

U.S. PATENT DOCUMENTS

| | | | |
|---|---|---|---|
| 1,814,816 | 7/1931 | Appelbaum | 229/34 R X |
| 1,983,689 | 12/1934 | Bedell | 229/52 B |
| 2,268,906 | 1/1942 | Scheer | 229/52 B X |
| 2,351,207 | 6/1944 | Henderson et al. | 229/52 B |
| 2,548,001 | 4/1951 | Butterfill | 229/33 X |
| 2,619,276 | 11/1952 | Gibbons | 229/33 |
| 2,852,177 | 9/1958 | Frasch | 229/33 X |
| 2,887,389 | 5/1959 | Linville | 229/36 UX |
| 3,040,955 | 6/1962 | Paul | 229/34 R X |
| 3,286,901 | 11/1966 | Anderson | 229/34 R X |
| 3,698,548 | 10/1972 | Stenzel | 229/34 R X |
| 3,826,420 | 7/1974 | Bamburg et al. | 229/33 X |

*Primary Examiner*—Davis T. Moorhead

[57] ABSTRACT

The container of the present invention is constructed from a single blank of cut and scored paperboard to form a pair of hinged sections which meet one another when the container is closed. Each section of the container is self locking and comprises double wall top and bottom panels and integral handles. In addtion, one of the sections includes a locking flap with integral locking ears for frictionally holding the two sections in closed condition.

4 Claims, 5 Drawing Figures

HINGED PAPERBOARD CONTAINER

BACKGROUND OF INVENTION

The present invention relates generally to paperboard containers and more particularly to a paperboard container having two individual hinged sections that are formed from a single blank of paperboard. In addition, the container of the present invention has a reinforced top and bottom, a convenient frictional locking means, and integral handles on each individual section which enables the container and its contents to be readily transported. Finally, if desired, the container of the present invention also includes a provision whereby each individual hinged section can be partitioned to provide individual spaces for the packaged products.

Hinged containers of the class hereindescribed are not unknown in the prior art. For instance, U.S. Pat. Nos. 2,268,906 and 2,351,207 each show hinged containers prepared from single blanks of paperboard. However, in each instance, the two individual halves of the containers are arranged to fit one within the other to provide, in effect, a unitary final construction. Meanwhile, U.S. Pat. No. 1,983,689 shows a construction which has two individual halves that do not telescope. That is, the two halves meet one another substantially as disclosed in the present invention. However, a careful comparison of the construction shown in the latter patent with applicant's construction will show that applicant's construction is superior in several respects. Note for instance, that the blank used for the construction disclosed herein can be more readily nested and when nested, uses less paperboard for a given container volume than the patented construction. In addition, while both containers are set up without the aid of staples, glue or the like, the present construction is more rugged and is easier to set up than the patented construction.

SUMMARY OF INVENTION

It is an object of the present invention to provide a hinged paperboard container which is fabricated from a single blank of paperboard without the use of glue, staples, stitching or the like.

A further object of the present invention is to provide a two section container wherein each section is independently constructed with a reinforced top and bottom, and each section contains its own integral handle portion.

Another object of the present invention is to provide a hinged, two section container wherein the two sections meet one another when closed to provide an interior volume that is equal to the volume of each section added together.

A further object of the present invention is to provide a container of the class described wherein one of the sections of the container includes an integral locking means which is used to frictionally retain the two sections together when the container is closed.

Still another object hereof is to provide partition elements for each container section whereby the separate sections may be readily divided into individual compartments for accomodating a plurality of packaged products.

For the purpose of the present invention, a single blank of paperboard is cut and scored to provide a pair of open top trays which are hinged together along a common score line. Each of the tray like sections is further comprised of panels which form reinforced ends and single panel side walls. One end of each tray also includes an integral handle element so that the two tray ends actually end up as a reinforced bottom and handled top when the container is turned on one end. The container bottoms are each formed from three thicknesses of the blank material which are frictionally held together by a tab and slot arrangement provided along one of the bottom panels and in the bottom wall of each tray respectively. Meanwhile, the container tops are formed from what is a nominal two ply construction, with the third ply consisting of a pair of overlapping edge flaps which include tab and slot friction locks, and a centrally located handle portion which extends above the top of the container. The two handle portions are located along the inside edges of the two trays so that when the two trays are folded together, the two handles lie adjacent to one another where they provide equal support for the packaged products. In addition, one of the tray elements includes a locking flap with locking ears at the free end thereof for locking the two trays together in the closed condition of the container. And finally, each individual tray element may be provided with partition elements which divide the trays into individual compartments.

DETAILED DESCRIPTION

Figure 1:
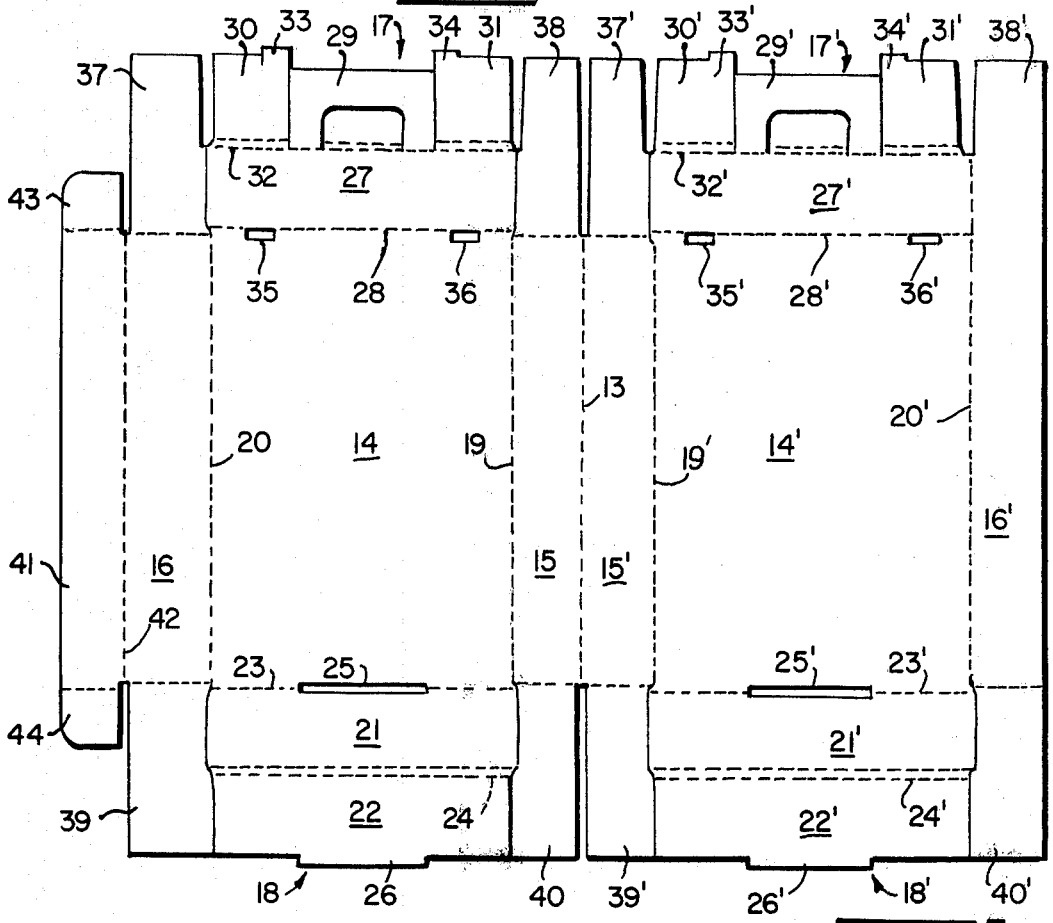
FIG. 1 shows in plan a typical blank structure for use in constructing the hinged container of the present invention.

Referring to the drawing, and in particular FIG. 1, there is illustrated a blank of corrugated paperboard or the like that is cut and scored for the purpose of preparing the hinged container of the present invention. The blank 10 is of substantially rectangular configuration having generally parallel top and bottom edges and opposed parallel lateral edges. Moreover, the blank 10 is divided into a pair of individual tray like sections 11,12 by a common fold line 13.

The individual tray like sections 11,12 are identically formed with separate bottom walls, side walls and end walls which together form a pair of connected trays that may be folded in abutting relation to meet one another and form a single container which encloses a volume that is equal to twice the volume of one individual tray. For this purpose, each tray comprises a bottom wall 14,14', a pair of side walls 15,16 and 15',16' and reinforced end walls 17,18 and 17',18'. The side walls 15,15' are connected together along the common score line 13 and are connected to their respective tray bottom walls along score lines 19,19'. Meanwhile, the side walls 16,16' are connected to their respective tray bottom walls along score lines 20,20'.

At the lower end of each tray bottom wall 14,14', the reinforced end walls 18,18' are formed from a pair of panels 21,22 and 21',22' that are foldably connected to their respective tray bottom walls along score lines 23,23' and which are connected together along the spaced score lines 24,24'. In addition, each of the outermost panels 22,22' has integrally formed on the outside edge thereof locking tabs 26,26' while a pair of cooperating locking slots 25,25' are formed along the score lines 23,23' which connect the end wall panels to their respective bottom walls.

At the upper end of each tray bottom wall 14,14', the reinforced end walls 17,17' are formed from a pair of panels which include panels 27 and 27' foldably attached to their respective bottom walls along score lines 28,28', and second outermost panels which are each divided into three portions. Thus, the second outermost panels of the end walls 17,17' include centrally located handle portions 29,29' flanked by locking flaps 30,31 and 30',31' all foldably attached to panels 27,27' along score lines 32,32'. Each of the locking flaps 30,31 and 30',31' include integral locking tabs 33,34 and 33',34' that cooperate with locking slots 35,36 and 35',36' in their respective bottom walls when the reinforced ends are formed. For the latter purpose, the blank is also provided with end reinforcing flaps 37,38,39,40 and 37',38',39',40' located at the ends of each of the side walls 16,16' along a score line 42. The locking flap 41 further includes a pair of locking ears 43,44 foldably attached to the ends thereof.

The container blank 10 is set up for use by first forming the two trays 11,12. In each case, since the trays are identical in construction, they are formed in the same manner. Thus, for the sake of brevity, only one tray will be described. In this regard, the lower end of tray 11 is formed by the reinforced end wall panels 18 when the reinforcing flaps 39,40 are folded inwardly and locking flap 22 is folded around about the spaced score lines 24 to capture the flaps 39,40. When the locking flap 22 is folded around to lie adjacent to the inner end wall panel 21, the integral locking tab 26 thereof becomes engaged in the locking slot 25 provided therefor to produce a frictionally locked lower end. Similarly, the upper end of the tray 11 is formed from the reinforced end wall panels 17. For this purpose, the reinforcing flaps 37,38 attached to side walls 15,16 are folded inwardly and are captured by the locking flaps 30,31 which are folded adjacent to the inner panel 27. At the same time, the handle portion 29 is folded upwardly to extend above the top end of the tray. When the locking flaps 30,31 are folded around, the integral locking tabs 33,34 become engaged in the cooperating locking slots 35,36 to provide a friction lock like the one for the bottom wall.

Figure 2:
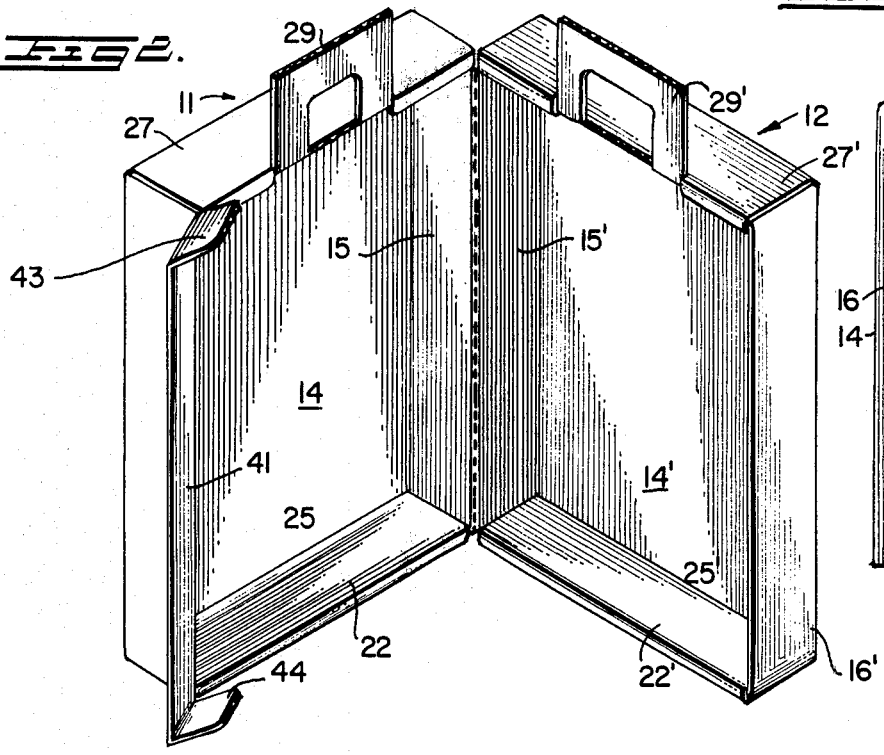
FIG. 2 is a perspective view of the container with the two tray sections open.
Figure 3:
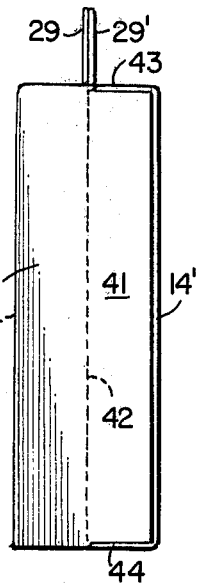
FIG. 3 is a side view of the container in closed condition.

After both trays 11,12 are formed, they assume the configuration shown in FIG. 2. At this point, they may stand upright as illustrated or be laid on their bottoms 14,14' as desired. In the upright condition, the reinforced end walls 18,18' form the bottom of the container and the reinforced end walls 17,17' form the top of the container. After one or more of the trays 11,12 are filled, they may be folded together and locked with the locking flap 41 when the locking ears 43,44 are tucked inside the reinforced end walls 17' and 18' of the opposite tray. At the same time, the upstanding handle portions 29,29' lie adjacent one another where they may be grasped together so that the load is evenly supported.

Figure 4:
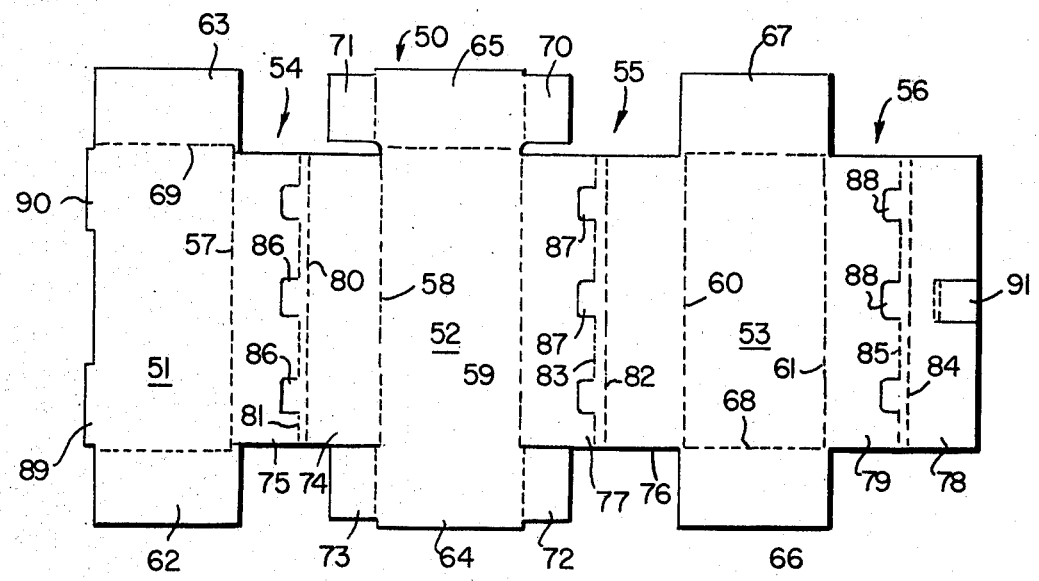
FIG. 4 is a plan view of a blank structure useful for making partition elements for the tray sections; and, FIG. 5 shows the container with the partition elements in place.

In the manner described above, a container is provided that is formed from two identical and independent trays that are interconnected along two adjacent side walls by a common score line. The two trays are folded together into face-to-face contact to enclose a space that is equal to the volume of both trays. The top and bottom ends of the container are reinforced and are fabricated without the use of staples, stitching or adhesive. Thus, the blanks may be shipped to the user in flat condition where they are erected for use.

Where it is desired to divide the interior of each tray into compartments, a second paperboard blank such as the one shown in FIG. 4 may be used to form a partition element. For this purpose, the partition element blank 50 shown in FIG. 4 is arranged to form three distinct compartments. Thus, the blank includes three base panels 51,52,53 separated from three partition elements 54,55,56 by scored lines 56,57, 58,59 and 60. The base panels 51,52,53 each have side stabilizing flaps 62,63,64,65 and 66,67 foldably attached thereto along scored lines 69,68, and the side stabilizing flaps 65,64 each include reinforcing flaps 71,70 and 73,72 foldably attached to the ends thereof. Meanwhile, the partition elements 54,55,56 each comprise a pair of foldable panels 75,74 and 77,76 and 79,78. These panels are separated from one another by spaced score lines 81,80 and 83,82 and 85,84. In addition, a series of flap elements 87,86 and 88 are formed between the panels 75,74 and 77,76 and 79,78 which are cut from one of the panels and foldably attached to the other panel to form article retaining flanges when the partition element is set up for use. Finally, for the purpose of retaining the partition element within its tray, means in the form of tabs 90,89 are provided on one end of base panel 51 and a flap element 91 at the opposite end of partition panel 78, which means interlock with its tray structure.

Figure 5:
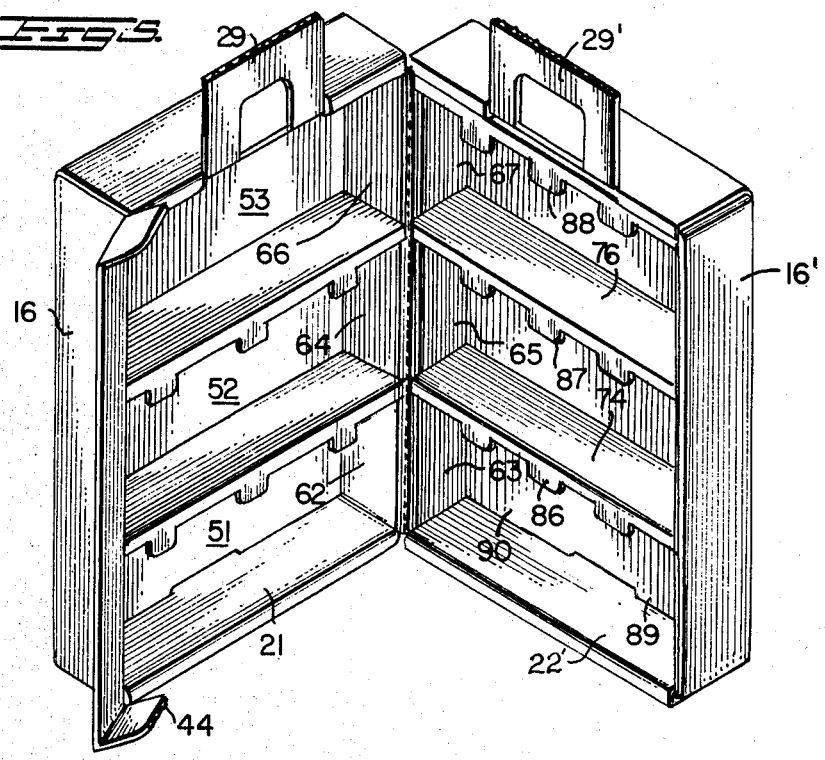

FIG. 5 illustrates the container of the present invention with the partition blank in place. In each case, the partition elements 54,55,56 extend perpendicular from their respective base panels 51,52,53 and the side stabilizing flaps 61,62,63,64,65 and 66 lie adjacent the tray side walls 15,15' and 16,16'. The reinforcing flaps 69,70,71,72 are tucked between the partition elements 54,55 and the flanges 85,86,87 extend into the space between the partition elements for retaining products in place. In the embodiment shown, the locking tabs 88,89 are arranged to lie on either side of the tab elements 26,26' of each tray bottom end wall, while the flap element 90 occupies the space created in the top tray end wall when the handle portions 29,29' are folded into their upright condition.

In each case, the blanks 10 and 50 may be cut and scored to suit the end users individual requirements. These blanks can then be shipped to the user in flat condition where they are set up without the need for staples, stitching or adhesives for use. It will thus be seen that a unique self locking hinged container has been disclosed which may be used for packaging a variety of different goods. For instance, the container may be used to package a variety of paints, brushes, paper and other paraphernalia as a paint-by-numbers kit. The container is also useful for packaging model cars, train sets, doll kits and for the beer can collector. Accordingly, while only a single embodiment of the invention has been fully disclosed herein, it will be understood by those skilled in the art that many modifications may be made without departing from the spirit and scope of the invention as defined in the appended claims.

I claim:

1. A container with integral handles formed from a single blank of corrugated paperboard or the like comprising a pair of connected trays which are foldable to meet one another and provide a single package enclosing a volume equal to the combined volume of each tray, the improvement wherein each tray comprises a reinforced construction including a bottom wall with foldably attached side walls, a plurality of end wall reinforcing flaps foldably attached to the ends of said side walls and a locking flap foldably attached to an edge of one of said side walls for frictionally locking said paired trays together, a multiple thickness end wall at the bottom of each tray and a handle containing end wall at the top of each tray, each bottom end wall having a triple thick construction consisting of a pair of panels which are folded together to capture a pair of end wall reinforcing flaps, each bottom end wall being held together by a locking tab on the end of one of said panels which is inserted in a cooperating locking slot in said bottom wall, each top end wall having a triple thick construction except in the handle area consisting of an outermost panel and an innermost panel, said outermost panel comprising three parts including a first centrally located handle portion which extends upwardly from the top end wall, and a pair of abbreviated locking flaps which are folded over to lie adjacent to said innermost panel and capture a pair of end wall reinforcing flaps, each top end wall being held together by locking tabs on the ends of said abbreviated locking flaps which are inserted in cooperating locking slots in said bottom wall.

2. The container of claim 1 wherein the locking flap that is foldably attached to a lateral free edge of one of said second pair of side wall panels further includes a pair of locking ears foldably attached to the ends thereof.

3. The container of claim 2 wherein in the closed condition, the two trays come together and abut one another so that the locking flap attached to one tray side wall will lie outside the other tray side wall and the integral locking ears thereof become inserted within the panels forming the reinforced top and bottom of the container.

4. The container of claim 3 wherein at least one of said trays includes a separate divider element which separates said tray into individual compartments.

* * * * *